United States Patent [19]

King

[11] 4,416,438

[45] Nov. 22, 1983

[54] BOTTLE HOLDER

[76] Inventor: Sterling J. King, 311 Hillcrest Dr., Leucadia, Calif. 92024

[21] Appl. No.: 236,604

[22] Filed: Feb. 20, 1981

[51] Int. Cl.[3] ..... A47B 15/00

[52] U.S. Cl. ..... 248/102; 248/104

[58] Field of Search ..... 248/102, 103, 104, 105, 248/106, 107, 318; D24/47; 24/115 H, 129 R, 129 B, 129 W, 129 D, 129 A, 130

[56] References Cited

U.S. PATENT DOCUMENTS

| | | | |
|---|---|---|---|
| 1,272,272 | 7/1918 | Kell | 24/129 R |
| 1,401,340 | 12/1921 | Lindsay | 24/115 H |
| 2,457,972 | 1/1949 | Bailey | 248/103 |
| 2,654,556 | 10/1953 | Lathrop | 248/105 |
| 2,815,909 | 12/1957 | Paprocki et al. | 248/102 |
| 2,840,873 | 7/1958 | Meier | 24/115 H |
| 2,893,672 | 7/1959 | Vardan | 248/102 |
| 2,983,976 | 5/1961 | Ehmann | 24/129 W X |
| 3,827,790 | 8/1974 | Wenzel | 24/129 W X |

OTHER PUBLICATIONS

The Washington Daily News—Aug. 5, 1955.

*Primary Examiner*—William H. Schultz
*Assistant Examiner*—Ramon O. Ramirez
*Attorney, Agent, or Firm*—Brown & Martin

[57] ABSTRACT

A bottle holder for holding a baby's feeding bottle comprises an elongated flexible member having a loop at one end for securing about the neck of a feeding bottle, and an anchoring suction cup at the other end for selectively mounting on a smooth support surface in a feeding area or station.

3 Claims, 3 Drawing Figures

BOTTLE HOLDER

BACKGROUND OF THE INVENTION

The present invention relates to supports and pertains particularly to a bottle holder for baby's feeding bottle.

When an infant is being bottle fed, constant attention of an attendant is normally required to prevent the feeding bottle from falling or being knocked from the feeding area. Infants normally cannot hold the bottle themselves, or if they do, will frequently release it and permit it to fall to the floor.

Holders and brackets for such bottles have been proposed in the past. The prior art approach to this problem is illustrated in the following U.S. Patents:

U.S. Pat. No. 1,077,190 issued Oct. 28, 1913 to Degenfelder, which discloses an adjustable arm secured to a chair and including a clamp for holding the bottle.

U.S. Pat. No. 1,692,098 issued Nov. 20, 1928 to Sullivan, which discloses a wire frame member for encircling a bottle, with a chain and hook for hanging it on the side of a crib.

U.S. Pat. No. 3,332,563 issued July 25, 1967 to Reshan, which discloses a recepticle for holding a bottle with a clamp for clamping around the neck of the bottle and a cord with a loop for hanging around the neck of an attendent.

These various approaches, however, have not proven entirely satisfactory.

It is therefore desirable that more effective holders for infant's feeding bottles be available.

SUMMARY AND OBJECTS OF THE INVENTION

It is therefore the primary object of the present invention to provide an improved baby's feeding bottle holder.

In accordance with the primary aspect of the present invention, a baby's feeding bottle holder includes an elongated flexible strap member with detachable anchoring means at one end, and an adjustable loop means on the other end for encircling and securing to the neck of a baby's feeding bottle.

BRIEF DESCRIPTION OF THE DRAWINGS

The above and other objects and advantages of the present invention will become apparent from the following description when read in conjunction with the accompanying drawings wherein.

DETAILED DESCRIPTION OF PREFERRED EMBODIMENTS

Figure 1:
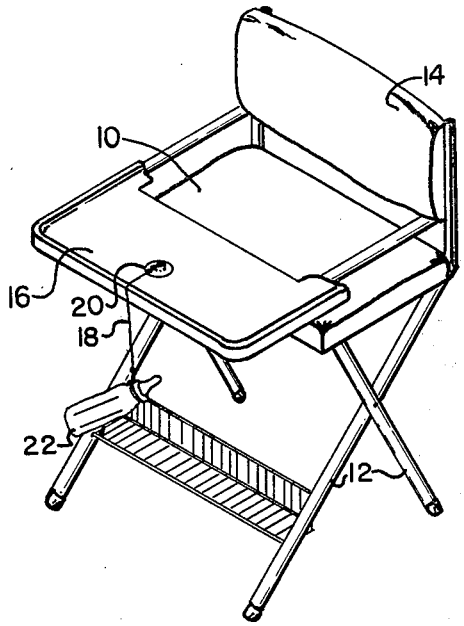
FIG. 1 is a perspective view showing a typical mounting of a feeding bottle in accordance with the invention.

Turning to FIG. 1 of the drawings, there is illustrated a typical feeding area or station for an infant which as illustrated consists essentially of a baby's high chair having a seat portion 10 supported on a plurality of legs 12 with a back 14 and a removable tray portion 16. Such chairs are typically designed to permit the placement of an infant in the seat of the chair, and securing the tray 16 in a position to restrain the infant in it's position in the chair. This enables the infant to be left relatively unattended for short periods of time.

Should the infant be in the process of feeding from a bottle, however, it can easily drop or knock the bottle from the tray or chair with the result that the bottle will land on the floor. This is undesirable because the infant is no longer able to feed, and because the floor can be unsanitary.

In addition, it is necessary for the attendant to stoop and retrieve the bottle from the floor each time it is thrown, dropped or knocked to the floor.

The present invention is adapted to secure a bottle in a position to at least prevent it from falling to the floor. To this end, an elongated flexible member or lanyard 18 preferably of a mono filament plastic strap structure, such that can be easily wiped and cleaned when soiled is used. The member 18 preferably has a length that is sufficient to permit a bottle 22 to be anchored thereby, and manipulated and yet short enough so as not to become entangled with the infant and present a hazardous situation. I have found that the optimum unfinished length is approximately 26 inches. This permits the line to be anchored such as to the feeding tray, back of the chair, table top, refrigerator door, side windows and interior surfaces of automobiles, baby stroller trays, and other like structures.

The anchoring or mounting device 18 includes an anchoring member at one end which preferably consists of a suction cup 20 which is secured to one end of the flexible member 18, and includes a loop 32 at the other end for encircling and securing to in a detachable manner, the neck of a bottle 22.

Figure 2:
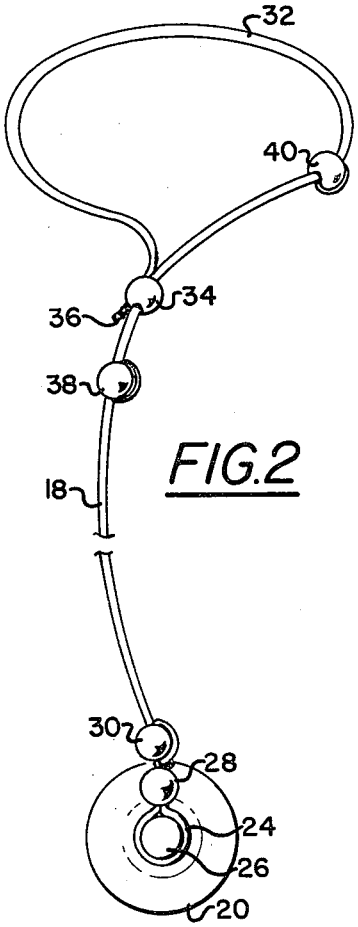
FIG. 2 is a plan view of the holder in accordance with the invention.

Turning to FIG. 2, the holding device or lanyard is shown in more detail, and consists or includes a loop 24 for encircling a knob member or portion 26 of a suction cup 20 for securing the flexible strap or member 18 to the suction cup 20. The loop is formed preferably by a slider member 28 which preferably consists of a bead or like member formed of a spherical member having a cylindrical bore 42 therethrough (FIG. 3) through which one end and the main body of the flexible member 18 extends. This slider member 28 permits the loop 24 to be snugged tight against the knob 26, and a stop of locking bead 30 drawn up against the slider member 28 for securing the loop in a fixed position for preventing the loop from opening.

A similar loop 32 is formed on the opposite end of the flexible member, and consists of a loop 32 having one end of the flexible member 18 extending through the bore of a slider member or bead 34, and a portion of the main body portion of the flexible member extending therethrough. A knot or the like 36 on the end of the flexible member 18 prevents the end thereof from slipping through hole or bore in the slider member 34. The maximum and minimum sizes of the loop 32 is established by movable or adjustable stop members or beads 38 and 40. The stop members consist of spherical members having a bore therethrough, thus defining essentially a bead like member. The flexible member 18 is extended through and looped over the side of the bead member and back through the central bore, thus looping it about one side of the spherical or bead member. This enables the stop member to be adjustably positioned along flexible member 18. The stop members 30, 38 and 40 are similarly formed and mounted on the flexible member 18.

Figure 3:
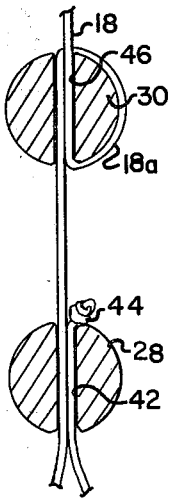
FIG. 3 is an enlarged view in section showing details of a portion of the holder.

Turning to FIG. 3 of the drawing, a detailed illustration is shown of the slider member 28, and its mounting, on the end of flexible member 18 to form loop 24. As seen, the body of the flexible member 18 extends through a bore 42 in the bead member 28, and forms the loop and extends back through the bore 42 in the opposite direction, terminating at the end thereof in the form of a knot or the like 44 preventing the end of the flexible member from being drawn through the cylinder or cylindrical bore 42 and loss of the loop 24. The flexible member 18 is preferably flat with a thickness less than its width so that it will fit snugly in bores 42 and 46 in a double layer as shown in FIG. 3.

The stop member 30 consists of a bead member substantially identical to member 28 wherein the flexible member 18 extends through the central bore 46 thereof, loops over the side of the spherical member forming a loop portion 18*a* and extending back through bore 46 in its same direction as the previous portion. This forms a stop member such that when the loop 18 is drawn down tight against the sides of the spherical member 30, the member cannot be moved along the flexible member 18. However, should it be desired to move the stop member 30, the portions of flexible member 18 are fed through the bore 46 in opposite directions in a manner to increase the size of loop 18*a*, permitting it to pull away from the surface of member 30. The member 30 can then be slid along the flexible member to a desired position. Once a desired position is selected, the loop 18*a* is again drawn down tight against the side of the spherical member 30 preventing movement thereof.

The stops 38 and 40 are similarly constructed and formed permitting adjustment thereof. The stop 38 prevents the loop 32 from being enlarged to such an extent as to create a danger to an infant, yet large enough to encircle the neck of a feeding bottle 22. At the same time, the stop member 40 permits the loop 32 to be drawn down snug against the bottle neck, yet at the same time prevents the loop portion 32 from drawing through the center bore of the slide member 34, thus preventing loss of the loop 32.

The above described structure provides a simple and inexpensive flexible holding member for an infant's feeding bottle which enables the bottle to be anchored in a secure and convenient position for feeding an infant.

While I have illustrated and described my invention by means of specific embodiments, it is to be understood that numerous changes and modifications may be made therein without departing from the spirit and scope of the invention as defined in the appended claims.

I claim:

1. An infant's feeding bottle supporting apparatus comprising:

a suction cup for detachable attachment to a flat support surface and including an attachment knob, an elongated flexible strap having a maximum length of twenty-six inches secured at one end to said suction cup attachment knob, adjustable loop means formed at the other end of said flexible member for detachably securing around the neck of a nursing bottle, a bead secured to said other end and slidable on said flexible member for defining said adjustable loop means, loop retaining stop means and safety stop means for defining the minimum and maximum sizes of said loop, and said stop means comprising beads having through-bore and said flexible member extending through the bore.

2. The supporting apparatus of claim 1 wherein said flexible strap loops over and extends through the bore of said beads in opposite directions to define said stop means.

3. The supporting apparatus of claim 2 wherein said flexible strap is flat with a thickness less than its width.

* * * * *